US012043476B2

(12) United States Patent
Ferri et al.

(10) Patent No.: US 12,043,476 B2
(45) Date of Patent: Jul. 23, 2024

(54) THERMAL AND BREATHABLE LINER FOR TRANSPORT CONTAINERS

(71) Applicants: Eugenio Matias Ferri, Buenos Aires (AR); Alejandro Steinhauser, Buenos Aires (AR)

(72) Inventors: Eugenio Matias Ferri, Buenos Aires (AR); Alejandro Steinhauser, Buenos Aires (AR)

( * ) Notice: Subject to any disclaimer, the term of this patent is extended or adjusted under 35 U.S.C. 154(b) by 116 days.

(21) Appl. No.: 17/718,057

(22) Filed: Apr. 11, 2022

(65) Prior Publication Data

US 2022/0411178 A1 Dec. 29, 2022

Related U.S. Application Data

(60) Provisional application No. 63/173,046, filed on Apr. 9, 2021.

(51) Int. Cl.
*B65D 90/04* (2006.01)

(52) U.S. Cl.
CPC ..... *B65D 90/046* (2013.01); *B65D 2590/04* (2013.01)

(58) Field of Classification Search
CPC .... B65D 88/121; B65D 88/12; B65D 90/048; B65D 90/046; B65D 90/04; B65D 2590/043; B65D 2590/04
USPC ..... 220/1.6, 1.5, 592.26, 592.2, 62.21; 410/121
See application file for complete search history.

(56) References Cited

U.S. PATENT DOCUMENTS

| | | | | |
|---|---|---|---|---|
| 3,074,586 | A * | 1/1963 | Morrison | B65D 81/3823 220/900 |
| 4,911,317 | A | 3/1990 | Schloesser et al. | |
| 5,529,177 | A | 6/1996 | Podd et al. | |
| 5,547,331 | A | 8/1996 | Podd et al. | |
| 5,595,320 | A | 1/1997 | Aghassipour | |
| 6,662,962 | B2 | 12/2003 | Neto | |
| 6,988,632 | B2 | 1/2006 | Hardy et al. | |
| 7,416,091 | B2 | 8/2008 | Yong | |
| 8,690,021 | B2 | 4/2014 | Asraf | |
| 9,090,392 | B2 | 7/2015 | Loeschen et al. | |
| 9,586,745 | B1 | 3/2017 | Givler | |
| 2005/0263528 | A1 | 12/2005 | Maldonado et al. | |
| 2009/0314786 | A1 * | 12/2009 | Cardinale | B65D 5/606 220/592.2 |

(Continued)

FOREIGN PATENT DOCUMENTS

FR 3064611 A 10/2018

*Primary Examiner* — Robert J Hicks
(74) *Attorney, Agent, or Firm* — Malloy & Malloy, P.L.; Jennie S. Malloy

(57) ABSTRACT

A liner for a shipping container including one or more sections, each removably disposed in overlying relation to an interior side of the shipping container, and being formed of a thermally insulative material and including at least one breathable material segment. Each breathable material segment is at least partially formed of an air permeable material having an apertured construction structured to facilitate airflow therethrough, between inner and outer surfaces of a corresponding one of the one or more sections. The apertured construction of the one or more breathable material segments may be at least partially defined by an open mesh material or other materials which include a plurality of through holes integrally formed therein.

20 Claims, 3 Drawing Sheets

(56) References Cited

U.S. PATENT DOCUMENTS

| | | | | |
|---|---|---|---|---|
| 2014/0353317 | A1* | 12/2014 | Ranade | B65D 81/3816 264/249 |
| 2023/0159256 | A1* | 5/2023 | Vezina | B65D 71/0096 220/592.26 |

* cited by examiner

THERMAL AND BREATHABLE LINER FOR TRANSPORT CONTAINERS

The present application is based on, and a claim of priority is made under 35 U.S.C. Section 119(e) to a provisional patent application that is currently in the U.S. Patent and Trademark Office, namely, that having Ser. No. 63/173,046 and a filing date of Apr. 9, 2021, which is incorporated herein by reference in its entirety.

BACKGROUND OF THE INVENTION

Field of the Invention

The present invention is directed to a liner structured to be removably disposed in a predetermined operative position within the interior of a shipping container, wherein the liner is structured to provide both thermally insulative protection to the contained goods or cargo, as well as a degree of "breathability" to avoid or restrict condensation problems within the shipping container.

Description of the Related Art

During the transport of goods in large shipping containers, air humidity can cause a phenomenon known as "container rain," wherein water vapor condenses in the form of droplets inside the container, which may eventually fall onto the goods contained within the container and being transported as cargo. For example, the walls and doors of shipping containers are usually made of metal and as a result, will often have a temperature lower than the dew temperature of the air-water mixture during transport and storage. Because metallic materials have high thermal conductivity, the temperature of the container walls is strongly affected by external factors, such as outdoor ambient temperature and air circulation rate around the container, among others. This is particularly relevant in shipping containers used for maritime transport, which are subject to abrupt changes in atmospheric conditions.

Due to matter and energy transfer phenomena, air water vapor inside the container commonly condenses into small or "micro-drops" on the interior wall surfaces. Due to the coalescence of the microdroplets, packets comprised of liquid water began to form and accumulate on the interior surfaces of walls and ceiling of the container. Due to the action of gravity, such water packets can fall or drip towards the bottom and the contained goods or cargo within the container.

Continuous dripping of water onto the transported goods can cause various drawbacks, mainly the deterioration of materials due to the action of water, which can promote the development of micro-morphisms, as well as promote corrosion phenomena. This has economic or even safety and hygiene consequences, depending on the nature of the goods transported. As a result, it is estimated that about 10% to 15% of goods transported in shipping containers should be discarded once arriving at destination due to damage caused by condensation.

In an attempt to overcome existing problems of the type set forth above, efforts have been made to develop a suitable liner for shipping containers. However, some of these known cargo liners have been directed to thermal protection by using improved thermal insulation. Accordingly, while such thermal liners may have beneficial effects by controlling temperature, there still exists the problem of dealing with a relatively high amount of condensation which may occur under the conditions set forth herein. As a result, damage to stored and transported goods and cargo is still problematic.

Therefore, there still appears to be a need in this field of art for a container liner that provides efficient thermal insulation of the container goods in addition to allowing breathability in a manner which is sufficiently effective to alleviate condensation problems inside the container. In other words, there remains a need for an improved liner for shipping containers that ensures efficient thermal insulation of goods within the shipping container and concurrently allows adequate circulation of air and water vapor within the interior of the container, thereby minimizing and perhaps avoiding the phenomenon of condensation and/or "container rain."

SUMMARY OF THE INVENTION

The present invention is directed to a liner assembly intended for use within a shipping container and which is structured to provide both thermal insulative properties to the contents of the container as well as sufficient "breathability" to eliminate or sufficiently restrict condensation formation on the interior of the shipping container.

It is also to be noted that the one or more embodiments of the present invention are directed to a liner of the type intended for use in the "containerization" industry, comprising a system of intermodal freight, land and sea transport using intermodal containers commonly referred to as shipping containers and ISO containers. Moreover, as used herein the terminology "shipping container" is also meant to include, but not be limited to, containers of the type associated with semi-trailers commonly used on commercial highways and for roadway transportation.

In more specific terms, the liner of the present invention comprises at least one section, but in one or more other embodiments, and more practically, a plurality of sections, each of which is disposed in overlying covering relation to an interior surface of a shipping container, such as a side wall. Further, when the liner of this invention comprises a plurality of such sections, each section may be correspondingly dimensioned and configured to be operatively disposed in overlying, covering relation to specific interior sides or surfaces of the shipping container.

As represented in greater detail hereinafter, one preferred embodiment of the liner assembly of the present invention comprises two side sections, substantially oppositely disposed to one another, wherein each side section is disposed in overlying, covering relation to a lateral interior side of the shipping container. In cooperation therewith, two substantially oppositely disposed end sections may be operatively disposed in overlying relation to opposite longitudinal end sides of the shipping container. Also, in order to adequately enclose and/or surround the contained goods or cargo, this preferred embodiment of the liner assembly may include upper and lower sections respectively disposed in overlying, covering relation to an interior roof/ceiling or bottom/floor of the shipping container.

Additional structural features include each of the aforementioned one or more liner sections being at least partially formed of a thermally insulative material, specifically structured to provide thermally insulative properties and/or protection to the contained goods or cargo. In addition, each of the one or more liner sections may include at least one "breathable material segment". Moreover, each of the breathable material segments is structured to facilitate air flow therethrough between an inner surface and an outer surface of the corresponding section of the liner to which they are operatively attached and associated. For purposes of clarity, the inner surface of each of the liner sections is considered the surface facing inwardly towards the interior center portion of the shipping container, where in the "outer surface" is that surface facing towards and/or disposed in confronting relation to the interior surface of a correspondingly positioned container side or wall.

It is to be further noted that as used herein, the terminology "breathability," "breathable material," "breathable material segment" and the equivalent thereof refers to one or more components of the container liner of the present invention which is or are structured to allow the transfer of airflow between an inside and an outside of the liner. As such, the facilitated airflow will pass between the interior of the liner and the space between the liner and the interior surface of a correspondingly disposed container side. Moreover, this airflow or air transfer, as described in more detail herein, is accomplished by such breathable material and or breathable material segments comprising an air permeable material. In turn, such air permeable material may comprise a material having an apertured construction including a plurality of holes of sufficient size to facilitate such air transfer or airflow.

In one or more embodiments, the air permeable material and the apertured construction thereof can be defined by an open mesh material or other breathable material that allows the aforementioned air transfer or airflow therethrough. Further, and for purposes of clarity, the aforementioned mesh or open mesh material can be defined using conventional dictionary terms and include, but not be limited to, a barrier made of connected strands of metal, fiber or other flexible or ductile materials which is similar to a web or net in that it has a plurality of attached woven strands, which in turn, define a plurality of through-holes therebetween. In contrast, the breathable material comprising the air permeable, apertured construction may be other than an open mesh material such as a plastic, fabric or synthetic material including a plurality of spaced apart apertures of sufficient size to facilitate the aforementioned airflow or air transfer therethrough.

Also, in order to further facilitate the formation of condensation within the interior of the shipping container being exposed to the contained goods or cargo, a moisture absorbent material may be disposed in aligned relation to individual ones of the one or more breathable material segments and in fluid communicating, moisture absorbent relation to the air transfer or airflow passing through the breathable material segments. Further, and at least one embodiment the moisture absorbent material may be in the form of a plurality of moisture absorbent containers, structures, etc. collectively extending along at least a majority a length of each of the breathable material segments.

Therefore, the one or more preferred embodiments of the container liner of the present invention provides meaningful, high-efficiency thermal insulation to the contained goods or cargo, as well as restricting the formation of condensation on the interior of the shipping container. As such, the aforementioned inclusion of one or more breathable material segments in one or more or each of the liner sections provides and facilitates the circulation of air and water vapor efficiently and easily within the interior of the shipping container and between the interior of the container liner and the exterior thereof, such as the space between the interior surface of the container sides or walls and the outer surface of the one or more liner sections. The potentially harmful effects of condensation formation to the contained goods or cargo is eliminated or at least significantly reduced.

Yet additional preferred embodiments of the shipping container liner of the present invention comprises at least one or all of the liner sections of the present invention including a plurality of at least two breathable material segments integrated therein, in operative relation to the thermally insulative material associated with each of the liner sections. Further, the one or more liner sections including a plurality of breathable material segments comprises different ones of the plurality of breathable material segments extending along at least a majority of the length of an upper periphery and a lower periphery thereof.

In order to dispose and maintain the liner in the intended operative position within the interior of the shipping container and especially when the container liner is comprised of a plurality of attached or interconnected sections, a connector structure is disposed on or connected to the at least partially exterior portions of the liner and or the different sections of which it is comprised. Such a connector structure may include a plurality of hooks or other type connectors disposed to use effectively suspend the liner and/or portions thereof from a interior roof or ceiling surface. Inc. in cooperation there with such a connector structure may include a plurality of tapes or other type connectors cooperatively disposed relative to one another and the aforementioned plurality of hooks so as to maintain the different liner sections in substantially confronting or nearly overlying, covering relation to corresponding ones of the interior surfaces or sides of the container to which they are adjacently disposed. Such cooperatively disposed in structured connectors including the hooks, tapes, etc. are cooperatively and strategically disposed so as to prevent different ones of the plurality of sections from folding or collapsing inwardly toward the interior of the liner when in its intended operative position.

Therefore, at least one embodiment of the shipping container liner of the present invention provides thermally insulative protection as well as breathability for purposes of reducing condensation being exposed to the contained goods or cargo by comprising:

- two opposite side sections, two opposite longitudinal end sections, one upper section and one lower section, wherein each of these sections comprises a thermal insulating material;
- a closure structure located on one of the opposite longitudinal end sections;
- at least one breathable material segment that allows the transfer of selected air and water vapor transfer by facilitating airflow between the interior and exterior of the liner comprising:
- at least one breathable material segment comprises an open mesh material in the form of an elongated strip located on and extending along, one or both of the opposite side sections, as well as one of the opposite longitudinal sections, the other of the two opposite longitudinal sections may include the aforementioned closure structure comprising a pair of closure portions, and
- the one or more breathable material segments are disposed on one or more of the sections of the liner, in conjunction with the thermal insulating material.

In at least one embodiment of the present invention, the thermal material is composed of a multilayer material comprising:

- a first layer of aluminum and polyethylene;
- a second layer of alveolar and polyethylene film; and
- a third layer of opaque fabric or film.

In at least one embodiment of the present invention, the thermal insulating material is composed of aluminized raffia.

In at least one embodiment of the present invention, at least one of the breathable material segments is formed of an open mesh material located at a top of the side section and or end section, extending along a length thereof and preferably bordering the upper section.

In at least one embodiment of the present invention, the container liner comprises a plurality of breathable material segments one or each of which includes an open mesh material extending along an upper periphery of the corresponding liner section, preferably bordering the upper liner section, wherein one other of the breathable material segments is formed of an open mesh material and located at and extending along a lower periphery of the corresponding section liner, preferably bordering the lower liner section.

In at least one embodiment of the present invention, the breathable material segment is air permeable by virtue of an apertured construction thereof, wherein the apertured construction is at least partially defined by a plurality of through holes and wherein the size of each of the holes is generally between, but not limited to, ¼ inch and at least 1 inch.

In at least one embodiment of the present invention, the open mesh material comprises a barrier made of connected strands of different materials including, but not limited to metal, fiber synthetics or other flexible, ductile, semi-rigid and/or rigid material.

In at least one embodiment of the present invention, further comprises the inclusion of a moisture absorbent material preferably, but not necessarily, in the form of a plurality of moisture absorbent containers or structures disposed in the line relation to the open mesh material or other material from which the breathable material segment is formed and disposed in fluid communication with air transfer or air flow therethrough.

In at least one embodiment of the present invention, the breathable material segment may be formed from material other than an open mesh material including, but not limited to, plastic, fabric, synthetics, rigid or semi rigid material all of which have the aforementioned apertured construction sufficient to facilitate air transfer or air flow therethrough.

In at least one embodiment of the present invention, a plurality of or at least one pair of closure structures disposable between open and closed orientations and including attachment structures such as, but not limited to hook and loop type fasteners disposed and operative to maintain the closure structures in the closed orientation.

In at least one embodiment of the present invention, a connector structure is provided to support and maintain the one or more sections of the shipping container liner in an intended operative position, such as in confronting relation to interior surfaces of correspondence disposed sides of the shipping container.

In at least one embodiment of the present invention, the connector structure may include, but not be limited to a plurality of hooks located bordering the opposite side sections as well as a plurality of tapes bordering the upper and lower sections of the liner as well as oppositely deposed side sections thereof.

The present invention allows to solve the disadvantages of the liners the state of the art by providing a simple and effective thermal insulation of the goods inside a container, in addition to simple breathability means that avoids condensation problems inside the container.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
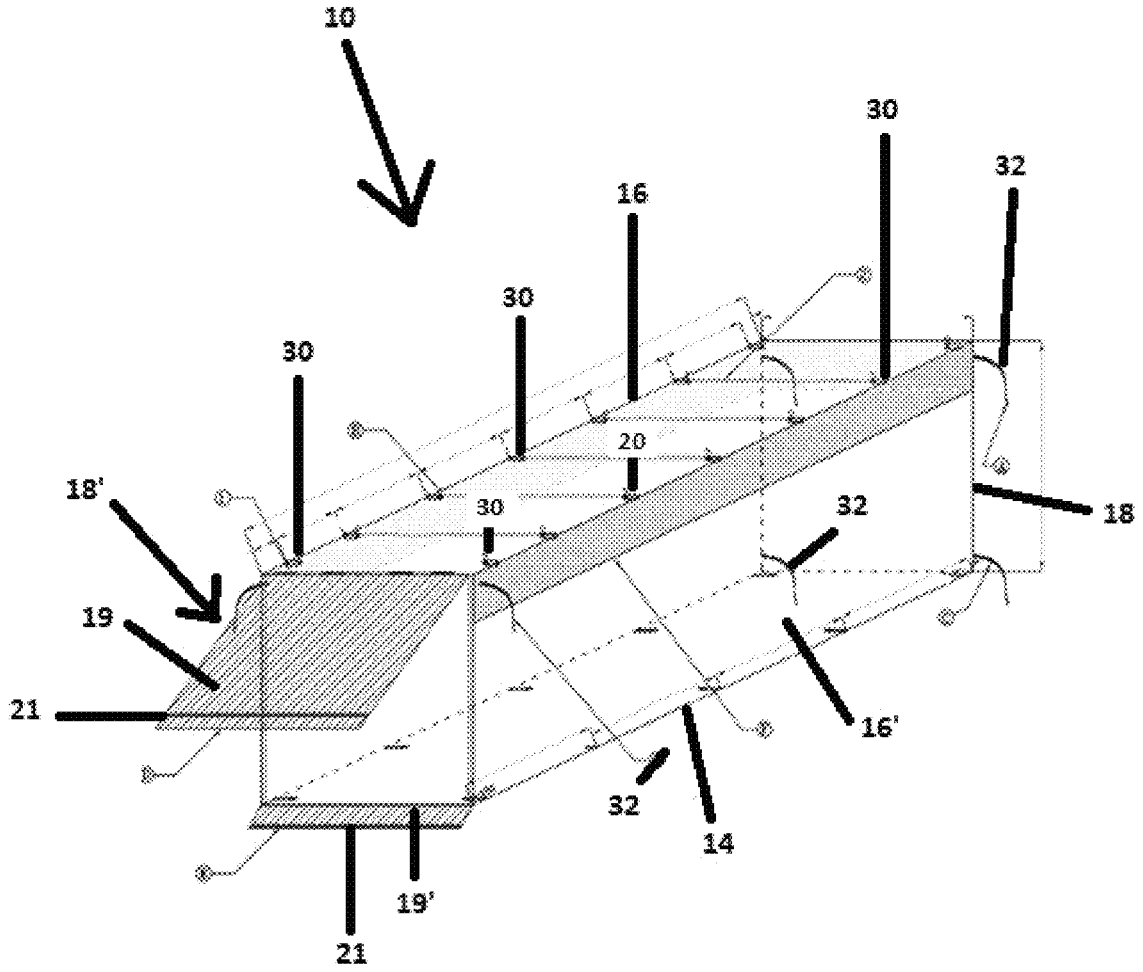
FIG. 1 is a perspective view in schematic form.

The invention now will be described more fully hereinafter with reference to the accompanying drawings in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As represented throughout the Figures, the present invention is directed to a liner, generally indicated as 10, operatively disposed on the interior of a shipping container (not shown for purposes of clarity) which is structured to provide both thermal insulative properties to the contents of the container as well as sufficient "breathability" to avoid or sufficiently restrict condensation formation on the interior of the shipping container.

As indicated, the one or more embodiments of the shipping container liner 10 are of the type intended for use in the "containerization" industry, including containers intended for both land and sea transport. As such, the containers are commonly referred to as shipping containers and ISO containers. In addition, the term "shipping container" or its equivalent is also meant to include, but not be limited to, containers of the type associated with semi-trailers used for commercial highway and roadway transportation.

Accordingly, one or more preferred embodiments of the container liner 10 comprise at least one section, but more practically a plurality of sections, each represented as 12. As such, each of the one or more liner sections 12 is disposed in overlying covering relation to interior surfaces of the sidewalls of a shipping container, as clearly represented in FIGS. 2 and 3. Further, when a plurality of such liner sections 12 are utilized, each section 14, 14', 16, 16', 18 and 18' may be correspondingly dimensioned and configured to be operatively disposed in overlying, covering relation to all or a significant majority of specific interior sides or surfaces of the shipping container, as also represented in at least FIG. 3.

As represented in greater detail hereinafter, one preferred embodiment of the liner 10 of the present invention comprises two side sections 14 and 14', substantially oppositely disposed to one another, wherein each side section 14 and 14' is disposed in overlying, covering relation to a lateral interior side of the shipping container. In cooperation therewith, two substantially oppositely disposed end sections 16 and 16' may be operatively disposed in overlying relation to opposite longitudinal end sides of the shipping container. Also, in order to adequately enclose and/or surround the contained goods or cargo on the interior of the liner 10, a preferred embodiment thereof may also include upper and lower sections 18 and 18' respectively disposed in overlying, covering relation to an interior roof/ceiling and a bottom/floor of the shipping container.

Additional structural features of the liner 10 include each of the aforementioned one or more liner sections 12 being at least partially formed of a thermally insulative material 20, specifically structured to provide thermally insulative properties and/or protection to the contained goods or cargo. As also represented throughout at least FIGS. 2 and 3, the thermally insulative material 20 is structured to define a significant majority of the respective liner sections 12 with which it is operatively associated. In addition, each of the one or more liner sections 12 may include at least one "breathable material segment" 22. Moreover, each of the breathable material segments 22 is structured to facilitate air transfer or air flow therethrough between an inner surface and an outer surface of the corresponding section 12 of the liner 10 to which they are operatively attached and associated. For purposes of clarity, the inner surface of each of the liner sections 12 is considered the surface facing inwardly towards the interior, center portion of the shipping container, wherein the outer surface of each liner section 12 is that surface facing towards and/or disposed in confronting relation to the interior surface of a correspondingly positioned container side or wall.

It is to be further noted that as used herein, the term "breathability", "breathable material", "breathable material segment" and the equivalent thereof refers to the structure of the material from which each of the breathable material segments 22 of the container liner 10 is formed, which is structurally operable to facilitate the transfer of air or airflow between inside and outside of the liner sections 12. As such, the facilitated air transfer or airflow will pass between the interior of the liner and the space between the liner and the interior surface of a correspondingly disposed container side. Moreover, this airflow or air transfer, as described in more detail herein, is accomplished by such breathable material and or breathable material segments comprising an air permeable material. In turn, such air permeable material may comprise a material having an apertured construction including a plurality of holes of sufficient size to facilitate such air transfer or airflow.

In one or more embodiments, the air permeable material and the apertured construction thereof can be defined by an open mesh material or other breathable material that allows the aforementioned air transfer or airflow therethrough. Further, for purposes of clarity the aforementioned mesh or open mesh material can be defined using conventional dictionary terms and include, but not be limited to, a barrier made of connected strands of metal, fiber or other flexible or ductile materials which is similar to a web or net in that it has a plurality of attached woven strands, which in turn define a plurality of through holes therebetween. In contrast, the breathable material comprising the air permeable, apertured construction may be other than an open mesh material such as a plastic, fabric or synthetic material including a plurality of spaced apart apertures of sufficient size to facilitate the aforementioned airflow or air transfer therethrough.

Figure 2:
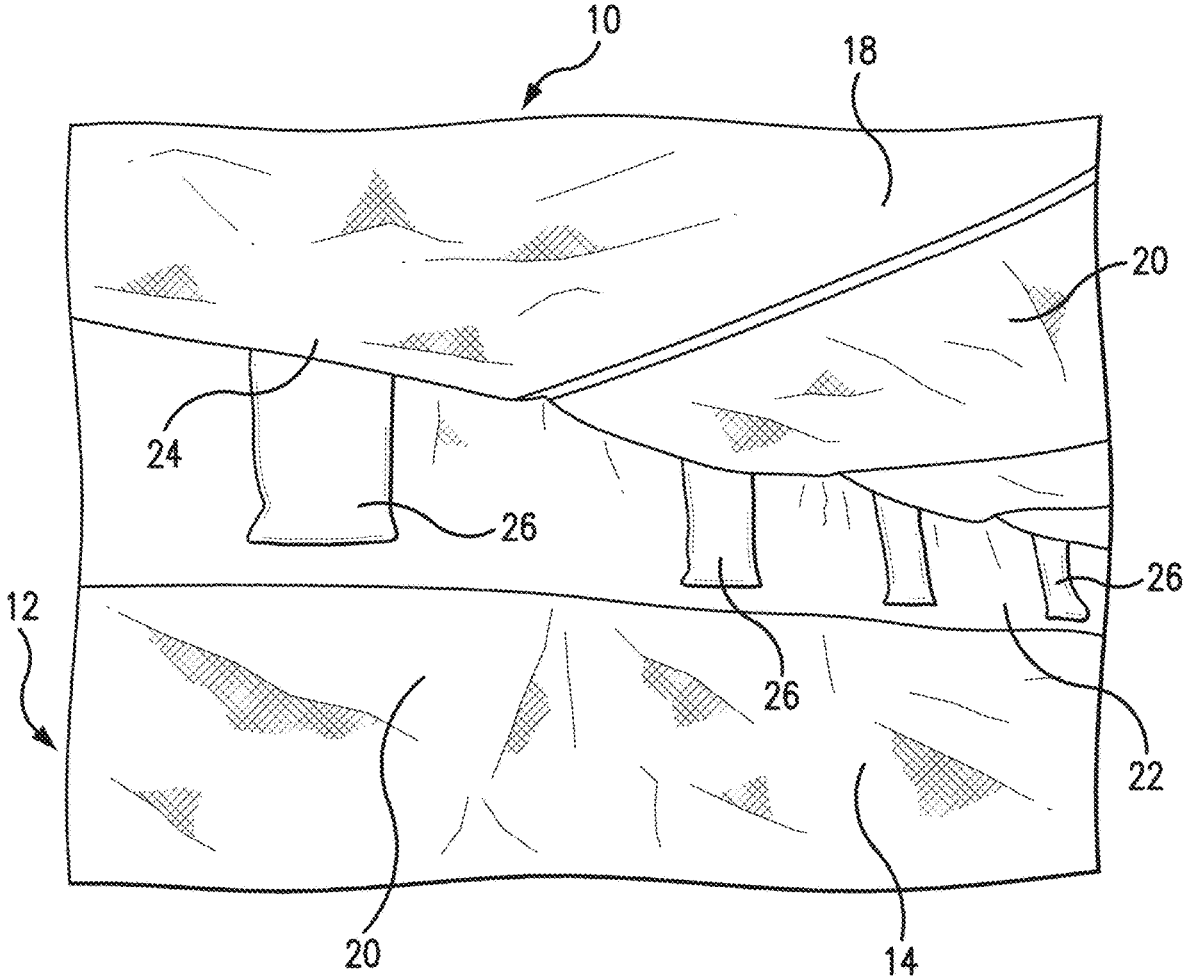
FIG. 2 is a perspective view in partial cutaway of structural features of at least one embodiment of the present invention.

Also, as represented in at least FIG. 2 in order to further prevent or significantly restrict the formation of condensation within the interior of the shipping container', a moisture absorbent material 24 may be disposed in aligned relation to individual ones of the one or more breathable material segments 22 and in fluid communicating, moisture absorbent relation to the air transfer or airflow passing through the breathable material segments 22. Further, in at least one embodiment the moisture absorbent material 24 may be in the form of a plurality of moisture absorbent containers, structures, etc. 26 collectively extending along at least a majority of each or selected ones of the breathable material segments 22.

Therefore, the one or more preferred embodiments of the container liner 10 of the present invention provides meaningful, high-efficiency thermal insulation to the contained goods or cargo, as well as restricting the formation of condensation on the interior of the shipping container. As such, the aforementioned inclusion of one or more breathable material segments 22 in one or more or each of the liner sections 12 provides and facilitates the circulation of air and water vapor efficiently and easily within the interior of the shipping container and between the interior of the container liner 10 and the exterior thereof, such as the space between the interior surface of the container sides or walls and the outer surface of the one or more liner sections 12. The potentially harmful effects of condensation formation to the contained goods or cargo are eliminated or at least significantly reduced.

Figure 3:
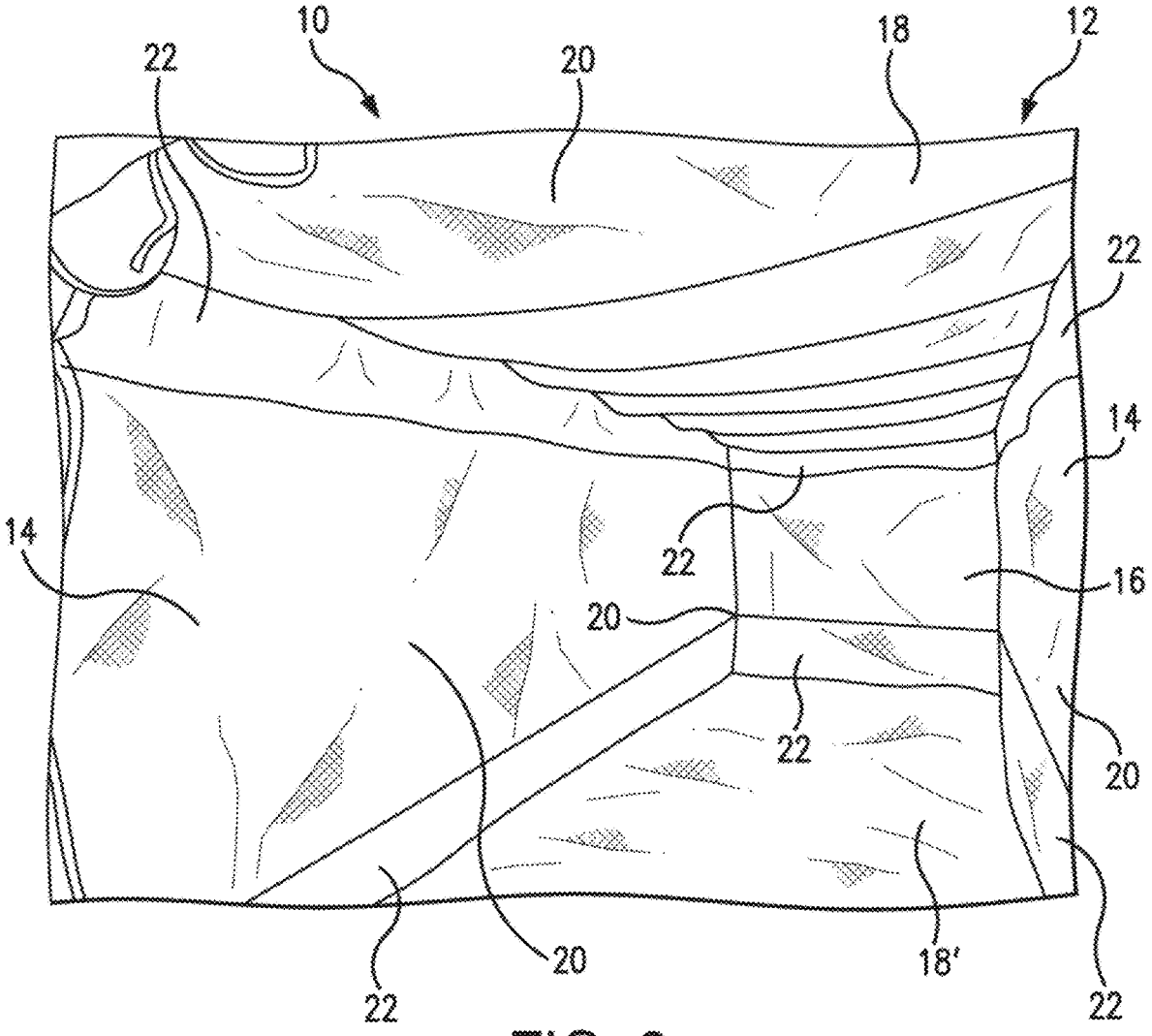
FIG. 3 is a perspective view of at least one preferred embodiment of the present invention.

With primary reference to FIG. 3, yet additional preferred embodiments of the shipping container liner 10 comprises at least one or all of the liner sections 12 including a plurality of at least two breathable material segments 22 integrated therein, in operative relation to the thermally insulative material 20 associated with each of the liner sections 12. Further, the one or more liner sections as at 14, 14' and 16 each include a plurality of breathable material segments 22, wherein different ones of the breathable material segments 22 extend along at least a majority of the length of an upper periphery and a lower periphery of at least a plurality of the side liner sections 14 and 14' and one longitudinal and section 16.

Moreover, in at least one embodiment of the present invention the longitudinal end 16' may be structured to define a closure structure including a plurality or at least a pair of closure portions 19 and 19' as schematically represented in FIG. 1. The closure structure and/or closure portions 19 and 19' are cooperatively disposable between open and closed orientations and may include including attachment structures 21 such as, but not limited to, hook and loop type fasteners disposed and operative to maintain the closure portions 19 and 19' in a closed orientation. Also, when the closure structure includes a plurality of closure portions as at 19 and 19', each may include a liner section 12 secured thereto and movable there with between the aforementioned open and closed orientations.

In order to dispose and maintain the liner 10 in the intended operative position, as collectively represented in FIGS. 1-3 within the interior of the shipping container and especially when the container liner 10 is comprised of a plurality of attached or interconnected sections 14, 14', 16, 16' 18 and 18', a connector structure 28 is disposed on or connected to an at least partially exterior of the liner 10 and/or the different sections 12 thereof, as clearly represented in FIG. 1. Such a connector structure 28 may include a plurality of hooks 30 or other type connectors disposed to effectively suspend and support the liner 10 from an interior roof or ceiling surface. In cooperation therewith, such a connector structure may also include a plurality of tapes 32 or other type connectors cooperatively disposed relative to one another and the aforementioned plurality of hooks 30 so as to collectively maintain the liner 10 and in particular each of the liner sections 12 in substantially confronting and/or overlying, covering relation to corresponding ones of the interior surfaces or sides of the container to which they are adjacently disposed. Such cooperatively disposed and structured connectors including the hooks 30, tapes 32, etc. are cooperatively and strategically disposed so as to prevent different ones of the plurality of sections 12 from folding or collapsing inwardly toward the interior of the liner when in its intended operative position as represented in at least FIG. 3.

Since many modifications, variations and changes in detail can be made to the described preferred embodiments of the invention, is intended that all matters in the foregoing description and shown in the accompanying drawings be interpreted in an illustrative and not in a limiting sense. Thus, the scope of the invention should be determined by the appended claims and their legal equivalents.

What is claimed is:

1. A liner for a shipping container comprising:

at least one section dimensioned and configured to be removably connected to an interior of a shipping container, said at least one section at least partially formed of a thermally insulative material and including at least one breathable material segment, said at least one breathable material segment structured to facilitate airflow therethrough between inner and outer surfaces of said at least one section, and said at least one section dimensioned and configured to overlie an interior side of the shipping container.

2. The liner as recited in claim 1 wherein said at least one breathable material segment is formed of an air permeable material.

3. The liner as recited in claim 2 wherein said air permeable material comprises an apertured construction including a plurality of through holes integrally formed in said breathable material segment.

4. The liner as recited in claim 2 wherein said air permeable material comprises an open mesh material having an apertured construction.

5. The liner as recited in claim 4 further comprising a moisture absorbent material disposed in aligned relation to said open mesh material and in fluid communication with said airflow through said at least one breathable segment.

6. The liner as recited in claim 5 wherein said moisture absorbent material comprises a plurality of moisture absorbent structures collectively extending along at least a majority of said air permeable material in spaced relation to one another.

7. The liner as recited in claim 1 wherein said at least one section comprises a plurality of breathable material segments each formed of an air permeable material.

8. The liner is recited in claim 7 wherein said air permeable material comprises an open mesh material having an apertured construction.

9. The liner as recited in claim 7 wherein said at least one section comprises different ones of said plurality of breathable material segments extending along at least a majority of a length of an upper and a lower periphery thereof.

10. The liner is recited in claim 1 further comprising a plurality of sections each disposed in removable, overlying relation to a different interior side of the shipping container; each of said plurality of sections formed of a thermally insulative material and including at least one breathable material segment.

11. The liner as recited in claim 10 wherein each of said breathable material segments is structured to facilitate airflow therethrough between inner and outer surfaces of a corresponding one of said plurality of sections.

12. The liner as recited in claim 11 wherein each of said breathable material segments are formed of an air permeable material comprising an open mesh material having an apertured construction.

13. The liner as recited in claim 1 wherein said thermally insulative material comprises a multilayer construction including a first layer of aluminum and polyethylene; a second layer of alveolar and polyethylene film and a third layer of opaque material.

14. The liner is recited in claim 1 wherein said thermally insulative material comprises aluminized raffia.

15. A liner for a shipping container comprising:

a plurality of sections each dimensioned and configured to be removably disposed in overlying relation to a correspondingly dimensioned and configured interior side of a shipping container, each of said plurality of sections formed of a thermally insulative material and including at least one breathable material segment, each of said breathable material segments at least partially formed of an air permeable material having an apertured construction; said air permeable material structured to facilitate airflow therethrough between inner and outer surfaces of a corresponding one of said plurality of sections, and said apertured construction comprising a plurality of through holes integrally formed in a corresponding one of said breathable material segments.

16. The liner is recited in claim 15 wherein said plurality of sections are attached to one another and concurrently disposable in a removable operative position within the shipping container.

17. The liner as recited in claim 15 wherein said plurality of sections include at least two side sections, oppositely disposed to one another; at least two end sections, oppositely disposed to one another and an upper section and a lower section, oppositely disposed to one another.

18. The liner as recited in claim 17 wherein said at least two side sections and at least one of said two end sections comprise a plurality of breathable material segments; different ones of said plurality of breathable material segments extending along at least a majority of the length of an upper and a lower periphery of the corresponding one of said at least two side sections and said at least one and section.

19. The liner is recited in claim 17 wherein at least one of said end sections comprises a closure structure disposable between closed and open orientations; said closed orientation comprising said plurality of sections collectively disposed in surrounding, enclosing relation to an interior of the shipping container.

20. The liner as recited in claim 15 wherein at least one of said plurality of sections comprises a plurality of breathable material segments; different ones of said plurality of breathable material segments extending along at least a majority of a length of an upper and a lower periphery of said at least one section.

* * * * *